US005447006A

United States Patent [19]

Zenor

[11] Patent Number: 5,447,006

[45] Date of Patent: Sep. 5, 1995

[54] METHOD FOR PATCHING SINGLE PLY ROOF

[75] Inventor: Glenn Zenor, Easthampton, Mass.

[73] Assignee: JPS Elastomerics Corporation, Northampton, Mass.

[21] Appl. No.: 257,868

[22] Filed: Jun. 10, 1994

[51] Int. Cl.[6] ..... E04G 23/03

[52] U.S. Cl. ..... 52/741.4; 52/411; 52/514; 52/746; 156/71; 156/94; 156/308.6

[58] Field of Search ..... 52/169.14, 411, 412, 52/514, 514.5, 516, 746, 741.4, 745.06; 156/71, 308.6, 309.3, 326, 94

[56] References Cited

U.S. PATENT DOCUMENTS

| | | | |
|---|---|---|---|
| 822,602 | 6/1906 | Gross et al. | 52/746 |
| 2,116,008 | 5/1938 | Block | 156/94 X |
| 2,458,032 | 1/1949 | Simon et al. | 156/94 X |
| 4,687,798 | 8/1987 | King, Sr. | 156/308.6 X |
| 4,725,328 | 2/1988 | Arnold | 52/746 X |
| 4,767,653 | 8/1988 | Renstrom | 428/40 |
| 4,948,431 | 8/1990 | Strickland et al. | 106/273.1 |
| 4,996,812 | 3/1991 | Venable | 52/741.4 X |
| 5,110,682 | 5/1992 | Bonazza | 156/281 X |
| 5,204,148 | 4/1993 | Alexander et al. | 52/514 X |
| 5,302,457 | 4/1994 | Sheahan | 428/411.1 |

FOREIGN PATENT DOCUMENTS

| | | | |
|---|---|---|---|
| 33106 | 7/1986 | Japan | 156/94 |

OTHER PUBLICATIONS

"Patch With Plastics", Modern Plastics, Dec. 1955 pp. 98–100, 222.

ARCO Chemical; NMP M-Methyl-2-Pyrrolidone.

*Primary Examiner*—Carl D. Friedman
*Assistant Examiner*—Laura A. Saladino
*Attorney, Agent, or Firm*—Fishman, Dionne & Cantor

[57] ABSTRACT

A low cost relatively simple method is presented for patching single ply roof membrane derived from chlorosulfonated polyethylene by using a procedure involving N-methyl-2-pyrrolidone or NMP chemical liquid activator with proper steps therebetween and subsequently completing the patching method by following standard known welding procedures. This method results in a welded seam that can be made as strong as the roof membrane itself.

4 Claims, 2 Drawing Sheets

METHOD FOR PATCHING SINGLE PLY ROOF

BACKGROUND OF THE INVENTION

This invention relates generally to patching roofing assemblies for the roofing and construction industry. More particularly, this invention relates to the patching of single ply roof membranes especially covered with sheets of flexible material such as chlorosulfonated polyethylene.

In certain modern roofing installations for commercial buildings, a layer of insulation is secured to the deck of the roof and this is covered with sheets of flexible material such as chlorosulfonated polyethylene. Adjacent margins of adjacent sheets are sealed together in overlapping relationship and thus the sheets form a sealing membrane over the insulation.

The sheets which form the membrane are secured to the insulation and the underlying roof deck at spaced locations by fastener assemblies which are spaced along the margins of the sheets. Each fastener assembly comprises a washer-like disc made of plastic or metal and further comprises a screw adapted to thread into the roof deck to cause the disc to clamp the membrane downwardly against the insulation. Roofs of this type are known as single ply roofs.

After long evaluation of various membrane polymers such as EPDM, PC, CPE and chlorosulfonated polyethylene (available from DuPont under the trademark HYPALON) many engineers in the field have chosen chlorosulfonated polyethylene as the membrane of choice in single ply roofing. Chlorosulfonated polyethylene is unique in that it is a thermoset synthetic rubber which, in its initial installed form, is thermoplastic in nature which allows chlorosulfonated polyethylene derived one ply membrane to be hot-air welded. Hot-air welding is accepted in the industry as the most reliable form of single-ply membrane seaming. A hot-air welded seam can be made as strong as the membrane itself.

Chlorosulfonated polyethylene has a polyethylene backbone with occasional —Cl and $SO_2Cl$ groups. A unique property of chlorosulfonated polyethylene is its ability to cure into a crosslinked rubber after installation and exposure to the natural elements. This is made possible by the aforementioned sulfonyl chloride groups contained along the polymer chain. When exposed to moisture and ultraviolet light on a roof, the groups form metal sulfonated cross links. The result is a progressive surface curing, or crosslinking, which actually adds strength and durability to the installed roof.

In one known installation technique, hot-air welds lifts the membrane edge, exposing inner surfaces to a controlled stream of superheated air. The thermoplastic rubber (HYPALON derived membrane) softens and is pressed together, fusing into a seam that can be made as strong as the membrane itself.

Outstanding weatherability and UV resistance has been demonstrated in various natural sunlight accelerated weathering tests. In real-time tests, including some actual roofing installations over thirteen years old, the chlorosulfonated polyethylene derived membrane continues to perform well, remaining watertight and highly reflective. UV resistance is critical to any roofing membrane, since the ultraviolet component of sunlight is by far the most destructive natural force on a roof. The chlorosulfonated polyethylene derived membrane is highly resistant to UV. Chlorosulfonated polyethylene derived membrane has been used for over 30 years in many severe weathering exposures with successful results.

Another great advantage of chlorosulfonated polyethylene derived single membrane roofing systems is that it weight only 33 pounds per square as compared to graveled built-up systems weighing up to 600 pounds or ballasted systems that weight up to 1500 pounds per square.

Ease of repair is a key requirement for any single ply roofing membrane. The addition of rooftop equipment, mechanical damage from natural forces or human error can necessitate a repair to even the best roofing system. Accordingly, single ply roofs at time will need repair, known as "patching". While well suited for its intended purposes, new methods for patching such single ply roof systems that are both easy and inexpensive as well as providing a patch that is as strong as the original membrane is required for chlorosulfonated polyethylene derived membrane roof systems.

SUMMARY OF THE INVENTION

The above-discussed and other problems and deficiencies of the prior art are overcome or alleviated by the method for patching single ply roofs of the present invention. In accordance with the present invention, a low cost, relative easy method for patching single ply roof membrane is provided wherein N-methyl-2-pyrrolidone (NMP) chemical liquid activator is used in an application sequence followed by the use of standard, known welding procedures to weld the patch section to the existing single ply roof membrane derived from chlorosulfonated polyethylene (typically available from DuPont). The NMP chemical is available from Arco Chemical Company of Newtown Square, Pa.

In accordance with the method of the invention, dirt and debris are removed from the surfaces that are to be seamed together. The surfaces are then wiped dry. The NMP activator chemical is then applied to surfaces that are to be seamed together and then removed from the seamed surface so that the surface appears dry. Finally, the patch membrane and existing membrane are welded together by following standard known welding procedures. The use of NMP activator as described herein results in a welded seam that can be made as strong as the membrane itself. Test results show that NMP activator acts as a temporary plasticizer allowing the patch membrane and existing membrane to be fused together into a homogeneous bond. It is believed that NMP acts as part solvent and part plasticizer. Laboratory data shows that NMP facilitates reactive curing of chlorosulfonated polyethylene derived membrane regardless of age.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
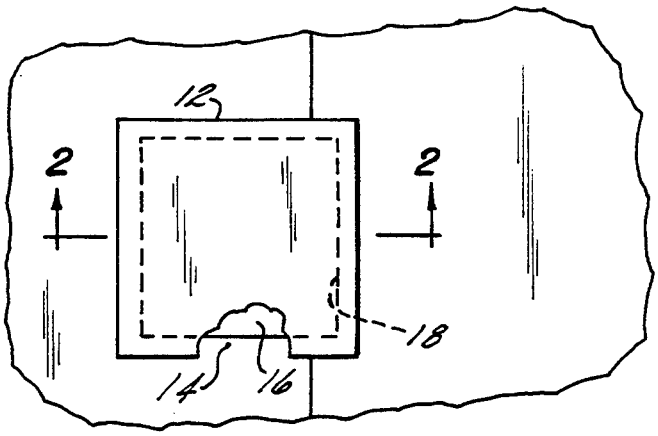
FIG. 1 is a plan view of a portion of existing roof membrane covered with a piece of membrane patch in accordance with the present invention.

Referring first to FIG. 1, the method for patching single ply roof of the present invention is shown generally in plan view. A single ply membrane patch is represented as the larger rectangle 12 overlapping existing single ply membrane 14 and covering cutout 16 (which corresponds to damaged existing single ply membrane which may or may not be removed) represented in dashed line by the rectangle 18.

Figure 2:
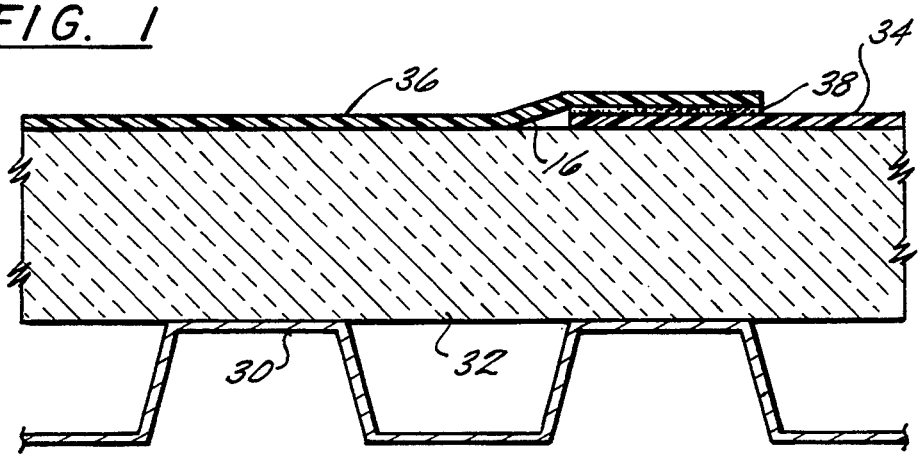
FIG. 2 is a typical cross-sectional elevation view of a typical single ply roof system taken along the line 2—2 of FIG. 1 prior to the removal of a damaged section.

Referring now to FIG. 2, a typical single ply roof system is shown in diagrammatic cross-section prior to removal of the piece of damaged single ply membrane 16 taken along the line 2—2 of FIG. 1. This roof system is comprised of a roof deck 30, a layer of insulation 32, a first sheet of flexible roof membrane 34 and a second sheet of roof membrane 36 overlapping membrane 34 and secured thereto using an adhesive 38 or a known hot-air welding method or any other known suitable sealing method or material. Typically known fasteners are used on known centers, preferably with known sealants to secure the single ply membrane to the deck as required.

The membrane 34 comprises chlorosulfonated polyethylene and preferably has 24% Cl and 1% S atoms. This preferred membrane can be manufactured using commercially available HYPALON 45 from DuPont.

Figure 3:
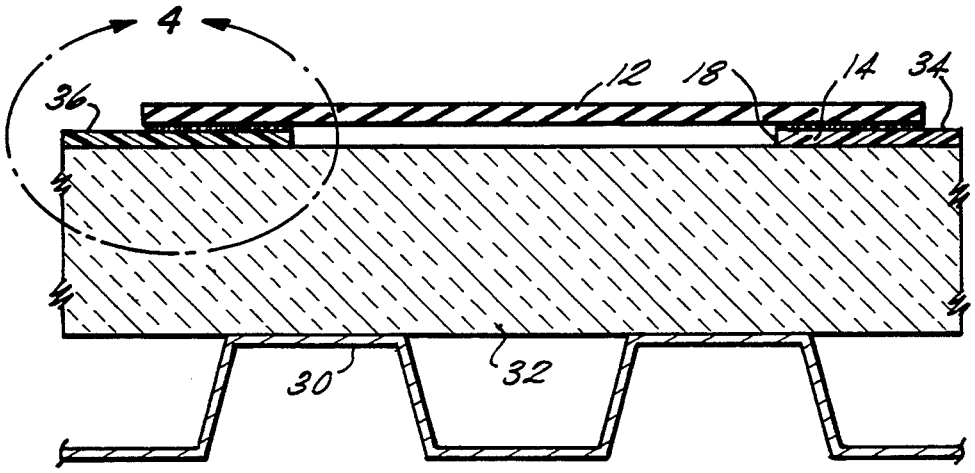
FIG. 3 is a cross-sectional elevation view taken along the line 2—2 of FIG. 1.

Referring now to FIG. 3, the method for patching single ply roof in accordance with the present invention is shown in diagrammatic cross-section after the removal of the piece of damaged single ply membrane 16 taken along the line 2—2 of FIG. 1. Of course, it should be noted that the damaged piece of membrane 16 often times is not required to be removed, or in many cases cannot readily be removed. There are also many situations where it is better to leave the damaged piece of membrane 16 as long as it does not damage the membrane patch 12.

Figure 4:
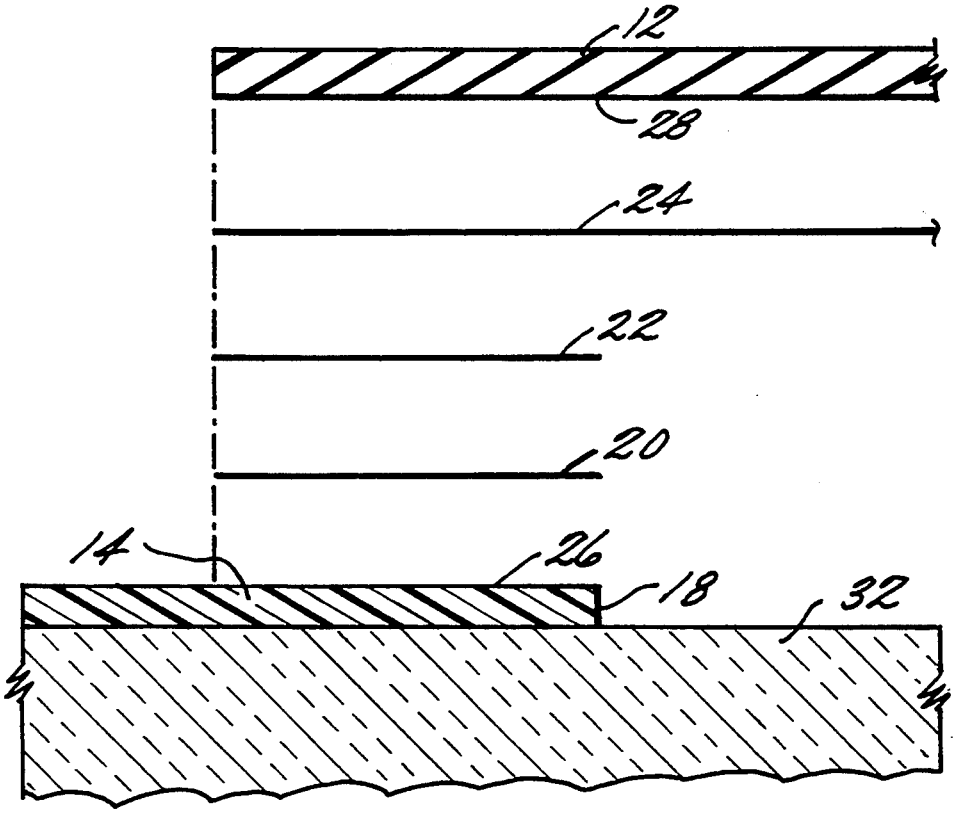
FIG. 4 is an enlarged exploded cross-sectional elevation view along the circle 4—4 of FIG. 3.

Referring to FIG. 4, the sequential steps of the method for patching single ply roof in accordance with the present invention for HYPALON derived membrane comprises the following procedure.

Step 1—Using a scrubbing pad 20 saturated with NMP activator chemical, scrub the area to be welded to loosen the dirt and/or particulate debris.

Step 2—Using a dry, clean white rag 22, wipe the area coated with NMP to remove the dirt and debris.

Step 3—Saturate a paint brush or other suitable applicator with NMP activator chemical 24 (such as is available from Arco Chemical Company of Newtown Square, Pa.) and wipe a coating of NMP onto the cleaned surface 26 (or surfaces) that are to be seamed together. The NMP should be left to set for at least about one (1) minute and should not be removed from the membrane in the area to be welded.

Step 4—The seamed surface 26 and the matching membrane patch seamed surface 28 are hot-air welded together in a known manner following standard welding procedures. This completes a method where the welded seam can be made as strong as the membrane itself due to the activation of the chlorosulfonated polyethylene caused by the NMP solvent activator.

It has been found that full strength laboratory grade NMP should be used (e.g., no dilution) for best results.

While preferred embodiment shave been shown and described, various modifications and substitutions may be made thereto without departing from the spirit and scope of the invention. Accordingly, it is to be understood that the present invention has been described by way of illustrations and not limitation.

What is claimed is:

1. A method of patching a portion of an existing single ply roof membrane composed of chlorosulfonated polyethylene, comprising the step of:

(1) activating a selected surface area of the existing single ply roof membrane in the vicinity of the portion of the existing single ply roof membrane to be patched by applying a coating of N-methyl-2-pyrrolidone (NMP);

(2) positioning a patch of roof membrane onto said portion of the existing single ply roof to be patched; and (3) heat welding said patch to said existing single ply roof membrane; wherein the NMP facilitates reactive curing between said existing single ply roof membrane and said patch.

2. The method of claim 1 including the step of:

cleaning said selected surface area prior to said activation step.

3. The method of claim 2 wherein said cleaning step includes:

scrubbing said selected surface area with NMP to loosen any dirt or like debris; and wiping the scrubbed selected surface area to remove any loosened dirt or like debris.

4. The method of claim 1 wherein:

said NMP is allowed to set on said selected surface area for at least about one minute prior to said heat welding step.

* * * * *